US009752413B2

(12) United States Patent
Behrens et al.

(10) Patent No.: US 9,752,413 B2
(45) Date of Patent: Sep. 5, 2017

(54) INJECTOR HEAD LIFTING BALE

(71) Applicant: PREMIER COIL SOLUTIONS, INC., Waller, TX (US)

(72) Inventors: Randall Dean Behrens, Sealy, TX (US); Shawn Shivers, Brenham, TX (US)

(73) Assignee: Premier Coil Solutions, Inc., Waller, TX (US)

( * ) Notice: Subject to any disclaimer, the term of this patent is extended or adjusted under 35 U.S.C. 154(b) by 0 days.

(21) Appl. No.: 14/719,023

(22) Filed: May 21, 2015

(65) Prior Publication Data

US 2016/0341008 A1 Nov. 24, 2016

(51) Int. Cl.
*E21B 41/00* (2006.01)
*E21B 19/08* (2006.01)
*E21B 19/00* (2006.01)

(52) U.S. Cl.
CPC ..... *E21B 41/00* (2013.01); *E21B 19/00* (2013.01); *E21B 19/08* (2013.01)

(58) Field of Classification Search
CPC ..... E21B 41/00; E21B 19/08
USPC ..... 166/379
See application file for complete search history.

(56) References Cited

U.S. PATENT DOCUMENTS 3,034,765 A * 5/1962 Wilhelm ..... B66F 3/22 182/69.5
3,841,688 A 10/1974 Karlsson
7,077,209 B2 7/2006 McCulloch et al.
8,240,968 B2 * 8/2012 Hopkins ..... E21B 19/155 414/22.55
2010/0328095 A1 * 12/2010 Hawthorn ..... E21B 17/028 340/854.3
2012/0186875 A1 * 7/2012 McDougall ..... E21B 44/02 175/57
2013/0175048 A1 * 7/2013 Goode ..... E21B 19/08 166/379

FOREIGN PATENT DOCUMENTS

FR 1273476 A 10/1961

OTHER PUBLICATIONS

Extended European Search Report (EP 16170911), dated Sep. 15, 2016.

* cited by examiner

*Primary Examiner* — Matthew R Buck
*Assistant Examiner* — Patrick Lambe
(74) *Attorney, Agent, or Firm* — Lloyd L. Davis; Andrews Kurth Kenyon LLP

(57) ABSTRACT

A lifting bale is mounted on top of an injector head for handling the injector head. The lifting bale includes a lifting arm attached to the injector head, an articulated member attached between the injector head and the lifting arm, the articulated member having a knee joint, and a cylinder, having an extendable and retractable arm, attached between the injector head and the knee joint. The cylinder arm is configured to be moved to raise the lifting arm, and is further configured to be extended and retracted to provide load balancing of the injector head.

7 Claims, 4 Drawing Sheets

INJECTOR HEAD LIFTING BALE

FIELD

Embodiments disclosed herein relate to a coiled tubing unit, more particularly, a lifting bale used to position injector heads in operation and during rig-up and rig-down operations.

BACKGROUND AND SUMMARY

The main engine of a coiled tubing unit is the injector head. This component contains the mechanism to push and pull the coiled tubing in and out of the well. The injector head is installed on the wellhead. The injector head should be at the correct angle relative to the wellhead to be installed correctly and provide proper entry of the coiled tubing into the wellhead.

In one aspect, embodiments disclosed herein relate to a lifting bale configured to be mounted on top of an injector head for handling the injector head, the lifting bale including a lifting arm attached to the injector head, an articulated member attached between the injector head and the lifting arm, the articulated member having a knee joint, and a cylinder, having an extendable and retractable arm, attached between the injector head and the knee joint. The cylinder arm is configured to be moved to raise the lifting arm, and is further configured to be extended and retracted to provide load balancing of the injector head.

In another aspect, embodiments disclosed herein relate to a method of handling an injector head, comprising pivotally attaching a lifting arm to the injector head, attaching an articulated member having a knee joint between the lifting arm and the injector head, attaching a cylinder having an arm between the injector head and the knee joint, manipulating the cylinder arm and raising the lifting arm, attaching a cable to a distal end of the raised lifting arm and positioning the injector head over a wellbore, and extending or retracting the cylinder arm to balance the injector head.

In yet another aspect, embodiments disclosed herein relate to a coiled tubing unit including an injector head, a gooseneck mounted on top of the injector head, a lifting bale mounted on top of the injector head, the lifting bale including a lifting arm attached to the injector head, an articulated member attached between the injector head and the lifting arm, the articulated member having a knee joint, and a cylinder having an arm attached between the injector head and the knee joint, wherein the cylinder arm is retracted and extended to balance the injector head.

BRIEF DESCRIPTION OF THE DRAWINGS

The invention is illustrated in the accompanying drawings wherein.

DETAILED DESCRIPTION

An injector head lifting bale is disclosed. The lifting bale is a mechanism configured to provide load balancing of an injector head during handling operations. The injector head lifting bale may be mounted on top of the injector head of a coiled tubing unit. The coiled tubing unit may include a complete set of equipment necessary to perform standard continuous-length tubing operations in the field. For example, the coiled tubing unit may comprise a reel for storage and transport of coiled tubing, an injector head to provide surface drive force to run and retrieve coiled tubing, a control cabin from which an equipment operator may monitor and control the coiled tubing, and a power pack to generate hydraulic and pneumatic power required to operate the coiled tubing unit. The coiled tubing units may further comprise other equipment for continuous-length or coiled tubing operations in the field. Moreover, in certain embodiments the coiled tubing unit may comprise onshore coiled tubing units such as a truck mounted coiled tubing unit or larger trailer mounted coiled tubing units. Still further, in other embodiments the coiled tubing unit may comprise offshore coiled tubing units such as those mounted on a lift boat, barge, offshore platform or any other offshore structure.

Figure 1:
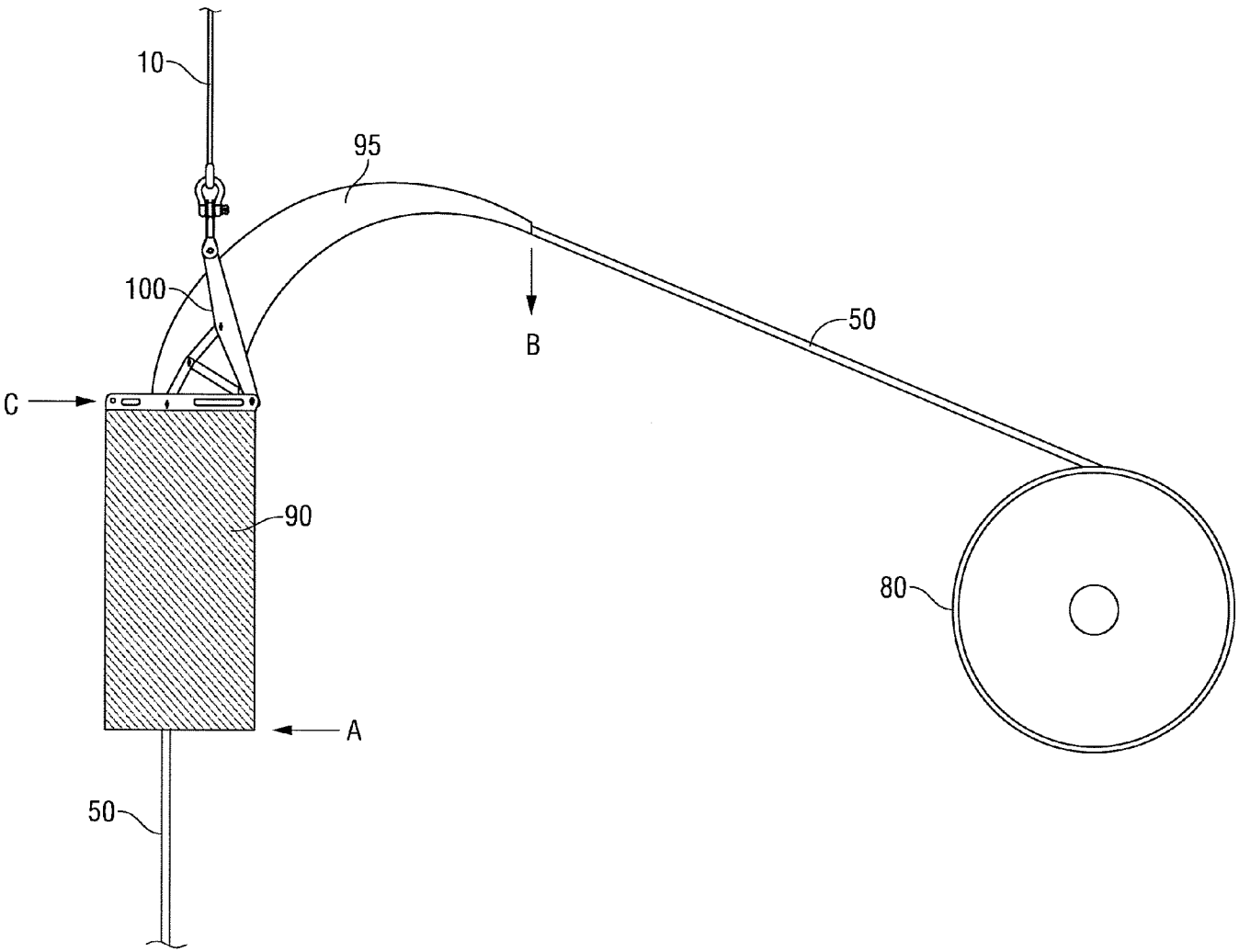
FIG. 1 illustrates a general layout of a coiled tubing unit.

The lifting bale is comprised of various arms secured with pins, hydraulic cylinders that can be manipulated for leveling the injector head, and an arm for connecting the lifting bale to a crane. FIG. 1 illustrates a general layout of a coiled tubing unit, and particularly, the lifting bale 100 mounted on top of the injector head 90. A suspension cable 10 extends downward from a crane (not shown) and attaches to the lifting bale 100. Coiled tubing 50 extends from a tubing reel 80, over a gooseneck 95, into an upper end of the injector head 90 and out a lower end into the well (not shown).

The lifting bale includes a lifting arm that is pivotally attached on a side or anywhere on the injector head. The lifting bale includes an articulated member attached between the lifting arm and the injector head. The articulated member has a knee joint coupling the first and second arms of the articulated member. For example, the knee joint may include a pin inserted through holes in the arms of the articulated member, or any other type of joint. The first arm is connected to a pivot point (e.g., pinned or otherwise) on the lifting arm at an end opposite the knee joint. The second arm is connected to a pivot point (e.g., pinned or otherwise) on a base structure at an end opposite the knee joint. The base structure may be part of the injector head on which the lifting bale is mounted.

The lifting bale further includes a cylinder having an extendable arm. The cylinder may be attached between the base structure and the articulated member. For example, the cylinder may be attached at a pivot point (e.g., pinned or otherwise) of the base structure and the knee joint (e.g., pinned or otherwise). Alternatively, the cylinder could be attached at a pivot point (not shown) on either the first arm or second arm. In one embodiment, the cylinder may be a hydraulic cylinder in fluid communication at any pressure with a hydraulic fluid source. In other embodiments, the cylinder may be pneumatic or electric. In yet other embodiments, the cylinder may be mechanical. The lifting bale may include one or more extendable cylinders and articulated members on each side of the injector head.

Figure 2:
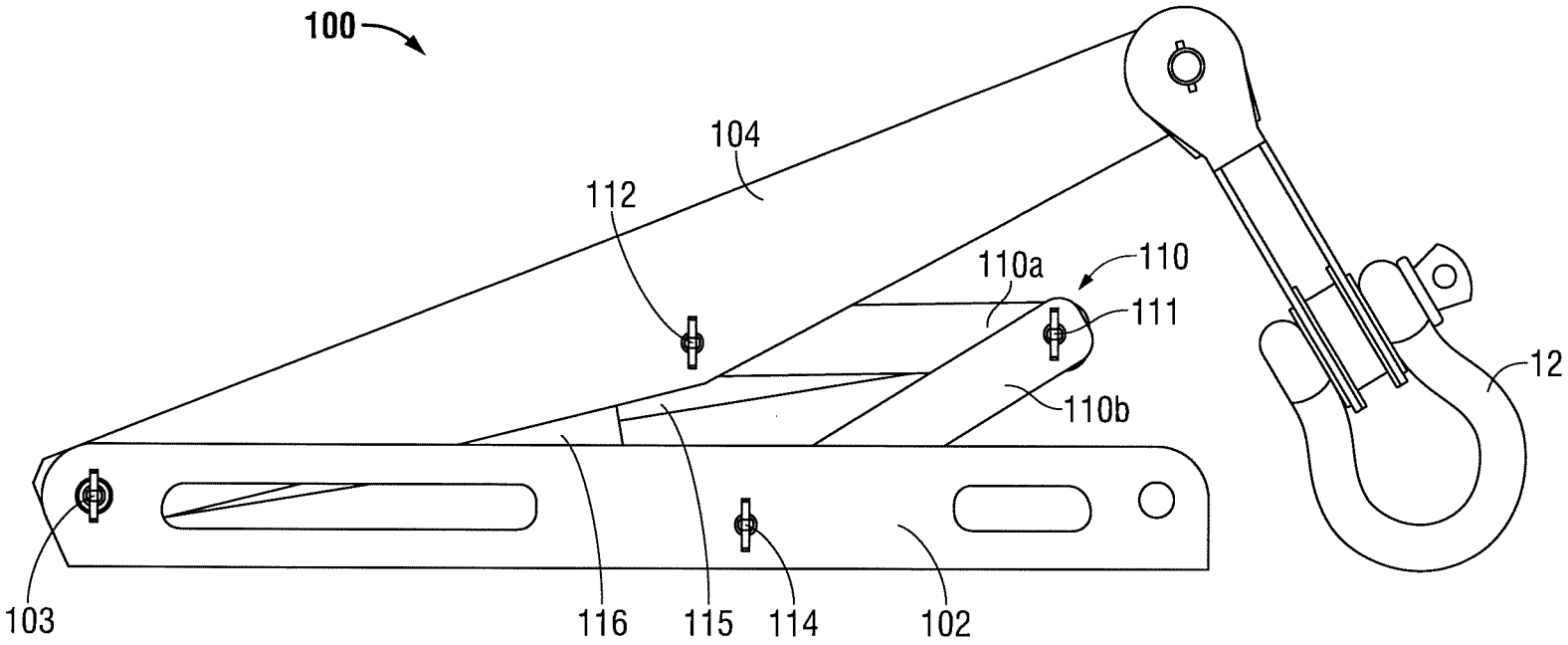
FIG. 2 illustrates a side view of an embodiment of a lifting bale in a collapsed position.
Figure 3:
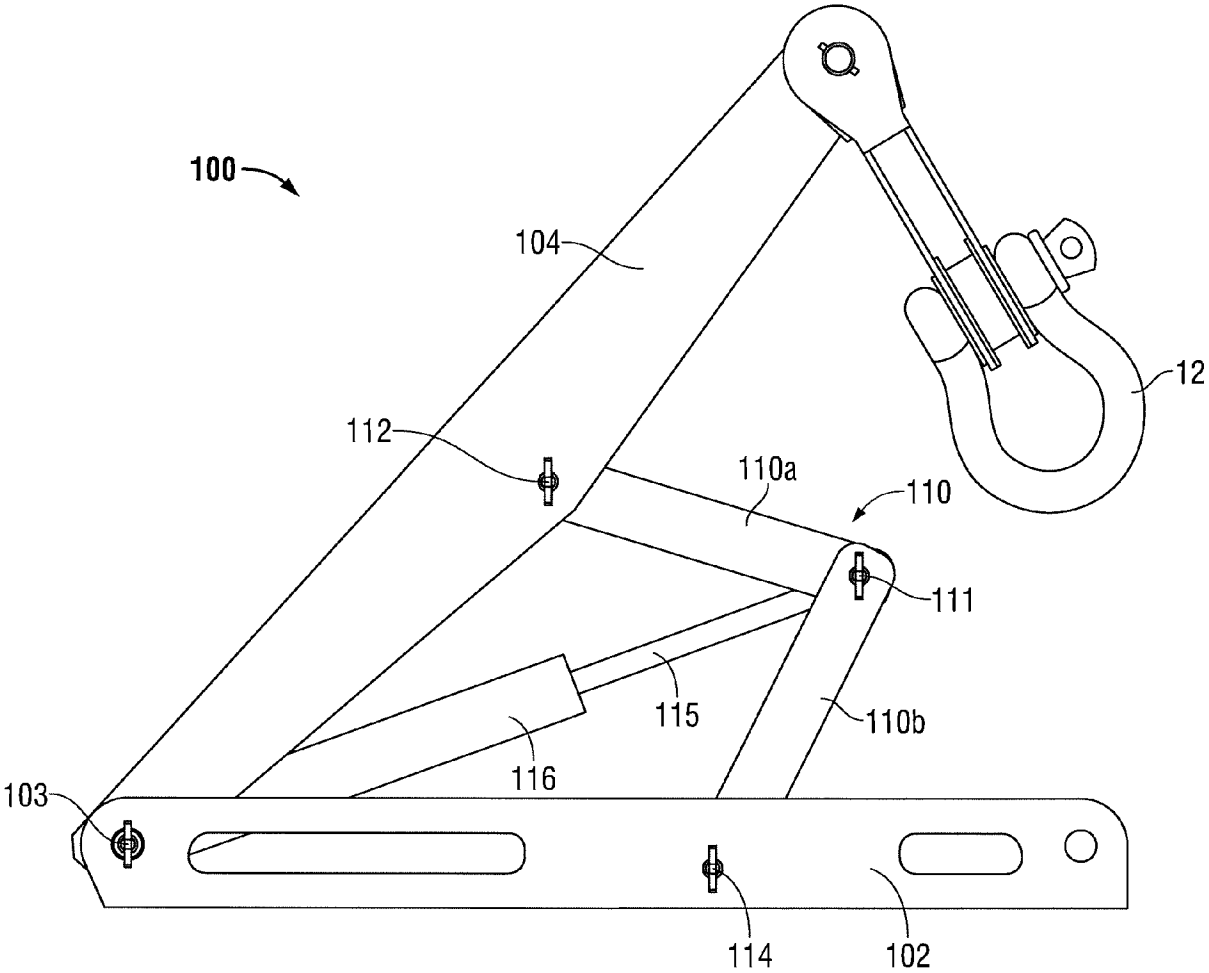
FIG. 3 illustrates a side view of an embodiment of a lifting bale in an intermediate extended position.
Figure 4:
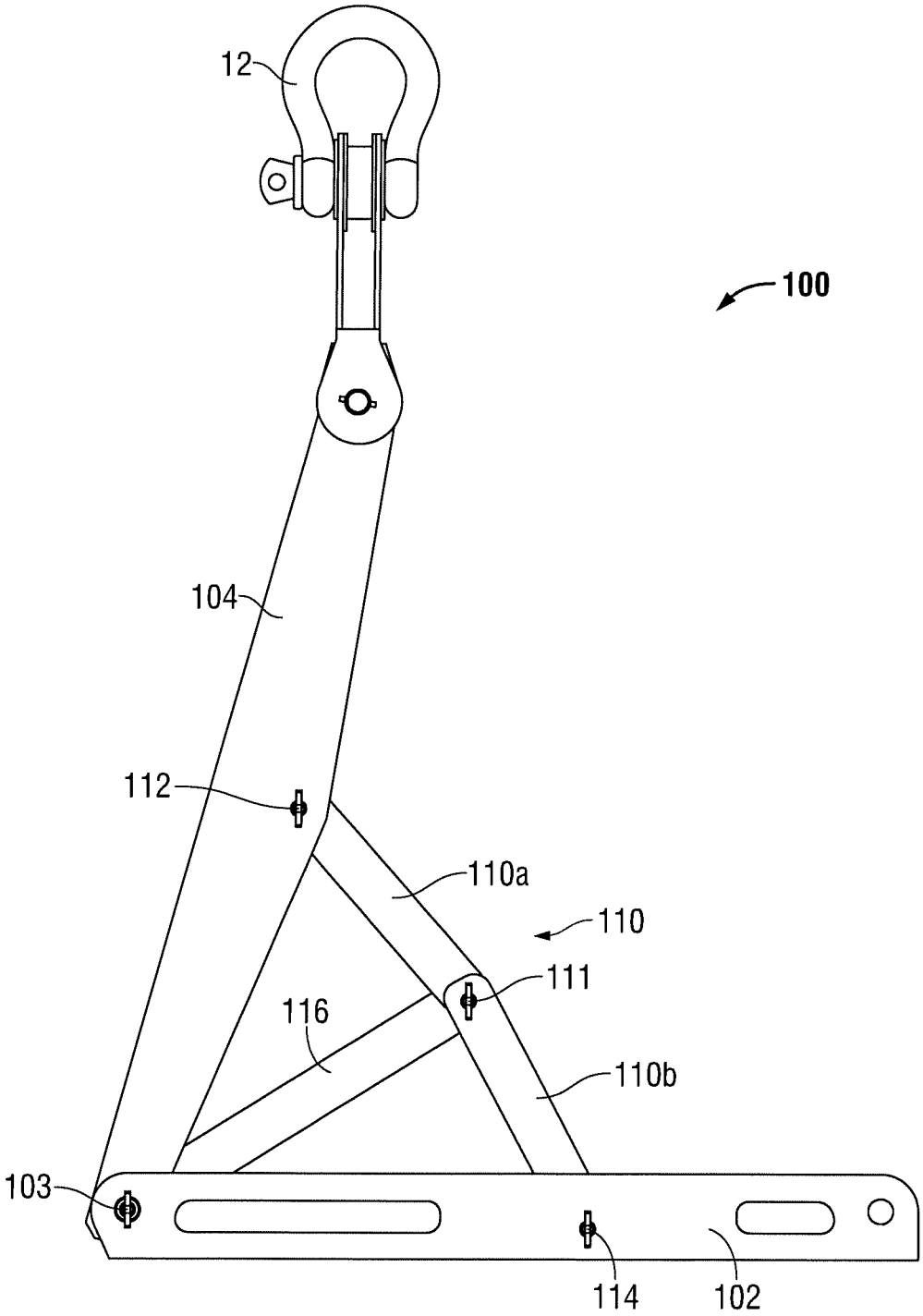
FIG. 4 illustrates a side view of an embodiment of a lifting bale in a fully extended position.

FIGS. 2-4 illustrate an embodiment of a lifting bale 100. The lifting bale 100 includes an articulated member 110. The articulated member 110 has a knee joint 111 coupling first and second arms (110*a*, 110*b*) of the member 110. For example, the knee joint 111 may include a pin inserted through holes in the arms of the articulated member 110, or any other type of joint. The first arm 110*a* is connected to a pivot point 112 (e.g., pinned or otherwise) on the lifting arm 104 at an end opposite the knee joint 111. The second arm

110*b* is connected to a pivot point 114 (e.g., pinned or otherwise) on a base structure 102 at an end opposite the knee joint 111. The base structure 102 may be part of the injector head (not shown) on which the lifting bale 100 is mounted.

The lifting bale 100 further includes a cylinder 116 having an extendable arm 115. The cylinder 116 may be attached between the base structure 102 and the articulated member 110. For example, the cylinder 116 may be attached at a pivot point 103 (e.g., pinned or otherwise) of the base structure 102 and the knee joint 111 (e.g., pinned or otherwise). Alternatively, the cylinder 116 could be attached at a pivot point (not shown) on either the first arm 110*a* or second arm 110*b*. In one embodiment, the cylinder 116 may be a hydraulic cylinder in fluid communication at any pressure with a hydraulic fluid source. In other embodiments, the cylinder 116 may be pneumatic or electric. In yet other embodiments, the cylinder 116 may be mechanical. The lifting bale 100 may include one or more extendable cylinders and articulated members on each side of the injector head.

During transport or at other times of nonuse, the lifting bale 100 is in the collapsed position (shown in FIG. 2) where the lifting arm 104 is lowered and almost completely horizontal. During use, the lifting arm 104 is raised in the extended position. Methods of using the lifting bale 100 include raising the lifting arm 104 from a collapsed position to an extended position for use, and then lowering the lifting arm 104 from the extended position to the collapsed position for storage or transport. No part of the lifting bale 100 need be unpinned or taken apart to completely collapse the lifting arm 104.

To raise the lifting arm 104 to a fully extended position (shown in FIG. 4), the cylinder 116 is actuated to retract the cylinder arms 115. The cylinder arm 115, because it is attached to the knee joint 111, pulls the articulated member 110, which straightens articulated member 110 and raises an end of the lifting arm 104. Knee joint 111 of the articulated member 110 is pulled until the arms of the articulated member 110 are almost straight. A cable 10 (shown in FIG. 1) extending downward from a crane (not shown) may be attached to a shackle assembly 12 pinned to a distal end of the lifting arm 104. When lifted, the knee joint allows most of the load to pass through the articulated member. The crane positions the injector head over the well.

As the injector head is positioned over the well, the lifting bale 100 may be manipulated to shift the center of gravity as required to maintain vertical alignment. Referring to FIG. 1, various forces may act on the injector head and move it out of vertical alignment with the well. For example, the center of gravity of the injector head may shift, directing the bottom of the injector head away from the tubing reel (see arrow "A" indicating direction), directing the tip of the gooseneck downward (see arrow "B"), or directing the top of the injector head towards the reel (see arrow "C"). In response, the hydraulic cylinder of the lifting bale may be actuated, either to extend or retract the arm 115, to compensate for the various movements.

To completely lower the lifting arm 104, the cylinder arm 115 is substantially fully extended.

The claimed subject matter is not to be limited in scope by the specific embodiments described herein. Indeed, various modifications of the invention in addition to those described herein will become apparent to those skilled in the art from the foregoing description. Such modifications are intended to fall within the scope of the appended claims.

What is claimed is:

1. A method of handling an injector head, the method comprising:

pivotally attaching a lifting arm at a first end to the injector head and at a second end to a lifting cable extending downward from a crane;

attaching an articulated member having a knee joint between the lifting arm and the injector head;

attaching a cylinder having an arm between the injector head and the knee joint;

manipulating the cylinder arm and raising the lifting arm;

positioning the injector head over a wellbore; and extending or retracting the cylinder arm to balance the injector head.

2. The method of claim 1, further comprising extending or retracting the cylinder arm as required to vertically align the injector head with the wellbore.

3. The method of claim 1, wherein the cylinder is hydraulic.

4. The method of claim 1, wherein the cylinder is electric.

5. A method of positioning an injector head over a wellbore, the method comprising:

pivotally attaching a lifting arm at a first end to the injector head and at a second end to a lifting cable extending downward from a crane;

attaching an articulated member having a knee joint between the lifting arm and the injector head;

attaching a cylinder having an arm between the injector head and the knee joint;

retracting the cylinder arm, and thereby raising the lifting arm;

positioning the injector head over the wellbore; and extending or retracting the cylinder arm to vertically align the injector head with the wellbore.

6. The method of claim 5, wherein the cylinder is hydraulic.

7. The method of claim 5, wherein the cylinder is electric.

* * * * *